United States Patent [19]

Anderson

[11] Patent Number: 5,039,132

[45] Date of Patent: Aug. 13, 1991

[54] METHOD AND FORM USED FOR ORDERING CUSTOM PRINTED PRODUCTS

[75] Inventor: Donn R. Anderson, River Falls, Wis.

[73] Assignee: Minnesota Mining and Manufacturing company, St. Paul, Minn.

[21] Appl. No.: 632,132

[22] Filed: Dec. 21, 1990

Related U.S. Application Data

[63] Continuation of Ser. No. 470,104, Jan. 25, 1990, Pat. No. 5,005,871.

[51] Int. Cl.[5] ..... B42D 15/00

[52] U.S. Cl. ..... 283/67; 283/61; 283/62

[58] Field of Search ..... 283/67, 61, 62

[56] References Cited

U.S. PATENT DOCUMENTS

| | | | |
|---|---|---|---|
| 1,550,256 | 8/1925 | Hollidge . | |
| 1,551,660 | 9/1925 | Gove . | |
| 4,189,353 | 2/1980 | Harriman | 283/67 |
| 4,272,327 | 6/1981 | Logan | 283/1 B |
| 4,664,418 | 5/1987 | Bear | 283/67 |
| 4,872,705 | 10/1989 | Hartfeil | 283/67 |
| 4,951,970 | 8/1990 | Burt | 283/67 |
| 4,993,752 | 2/1991 | Juszak | 283/67 |

FOREIGN PATENT DOCUMENTS

| | | | |
|---|---|---|---|
| 2639319 | 3/1978 | Fed. Rep. of Germany | 283/61 |

*Primary Examiner*—Frank T. Yost
*Assistant Examiner*—Hwei-Siu Payer
*Attorney, Agent, or Firm*—Gary L. Griswold; Walter N. Kirn; William L. Huebsch

[57] ABSTRACT

A method for providing custom printed surfaces on products such as sheets to a customer includes providing to the customer a form comprising a master portion corresponding in size and shape to a surface to be printed and an identifying portion for accepting identifying information concerning the customer, having the customer apply identifying information to the identifying portion of the form and indicia of a desired type to the master portion of the form, using the master portion of the form with the applied indicia as a graphic master to prepare the printed surfaces which can be prepared by conventional printing method from the master, and using the identifying portion of the form as a label to send the custom printed products to the customer.

10 Claims, 2 Drawing Sheets

METHOD AND FORM USED FOR ORDERING CUSTOM PRINTED PRODUCTS

This is a continuation of application Ser. No. 07/470,104 filed Jan. 25, 1990, now U.S. Pat. No. 5,005,871.

TECHNICAL FIELD

The present invention relates to methods and forms used for ordering custom printed products such as sheets included in note pads.

BACKGROUND ART

Using conventional known methods and forms for ordering custom printed products, particularly including sheets included in note pads that may have layers of repositionable pressure sensitive adhesive on portions of their rear surfaces, a customer typically indicates on the form a code for artwork selected from sample artworks in a book which the customer desires to have printed on the sheets, and/or manually prints on t e form a message and/or name that customer wishes to have printed on the sheets. The printer of the sheets then lays out the artwork and prints the message on a master sheet. The master sheet is then typically attached to a master lay out board, after which the sheets are printed utilizing conventional printing methods which may include making a printing plate by which the sheets are printed, which printing plate may be either made directly from the lay out board or by photographing the lay out board.

While this approach is generally acceptable, the customer is limited to the artwork provided by the printer, and the styles of printed messages the printer is willing to prepare, and errors can occur when the artwork and message are laid out.

DISCLOSURE OF INVENTION

The present invention provides a method for ordering custom printed surfaces on products (particularly including sheets collected into note pads that may have layers of repositionable pressure sensitive adhesive on portions of their rear surfaces), and also provides a form used in that method which affords almost unlimited latitude in the artwork and/ or message that can be printed on the surfaces, and substantially eliminates errors caused by by the printer in the artwork and/or message printed.

According to the present invention there is provided a method for providing custom printed surfaces on products (particularly including sheets) to a customer, which method generally comprises the steps of (1) providing a form comprising a master portion corresponding in size and shape to surfaces to be printed and an identifying portion for accepting identifying information concerning the customer; (2) having the customer apply identifying information to the identifying portion of the form and indicia of a desired type to the master portion of the form; (3) using the master portion of the form with the applied indicia as a graphic master to prepare the printed surfaces, which can be done by conventional known printing methods including making a printing plate by which the surfaces are printed either directly from the lay out board or by photographing the lay out board; and (4) using the identifying portion of the form as a label to send the printed products to the customer.

The method can also include providing a supply of prepared indicia adapted to be attached to the form as by a layer of repositionable adhesive, which indicia, if desired, may be transferred to the master portion of the form to provide all of the indicia used on the master portion of the form, or to provide part of the indicia used on the master portion of the form in combination with indicia printed manually on the master portion of the form or applied by other means such as with a typewriter or other type of printer. Of course the supply of prepared indicia may not be used at all, in which case only indicia printed manually on the master portion of the form or applied by other means such as with a typewriter or other type of printer may be used.

Preferably, the master portion and the identifying portion of the form have adjacent edges joined to each other and adapted to afford folding the form along the adjacent edges, the identifying portion of the form is smaller in area than the master portion of the form and is completely overlaid by the master portion of the form when the form is folded along the adjacent edges, and the step of using the master portion of the form with the applied indicia as a graphic master to prepare the printed surfaces comprises the step of folding the form along the adjacent edges to position the identifying portion along the side of the master portion opposite the indicia applied to the master portion, and releasably adhering the identifying portion and the master portion at a predetermined location on a substrate with the identifying portion adjacent the substrate. With such identifying and master portions the releasably adhering step can include the steps of providing a master layout board having a support surface and having areas of low tack pressure sensitive adhesive along the support surface, and pressing the folded form into engagement with the areas of low tack pressure sensitive adhesive with the identifying portion adjacent the adhesive so that the master layout board with a plurality of such folded forms attached may be used directly or be photographed to make a printing plate used in printing the surfaces.

A preferred novel form for use in the method described above comprises an informational portion bearing written instructions concerning the use of the form in addition to the master and identifying portions of the form having the preferred relationship described above. The form is perforated along the boundary between the informational portion and the master and identifying portions of the form so that before or after a customer applies identifying information to the identifying portion of the form and indicia of a desired type to the master portion of the form the identifying and master portions of the form can be separated from the informational portion of the form as a unit, folded along their adjacent edges to position the identifying portion along the side of the master portion opposite the indicia applied to the master portion, and the folded identifying and master portions of the form can be releasably adhered at a predetermined location on a substrate with the master portion of the form opposite the substrate to provide a graphic master for preparation of the printed surfaces; and the identifying portion of the form can thereafter be separated from the substrate and used as a label to send the printed products to the customer.

BRIEF DESCRIPTION OF DRAWING

The present invention will be further described with reference to the accompanying drawing wherein like reference numerals refer to like parts in the several views, and wherein.

DETAILED DESCRIPTION

Figure 3:
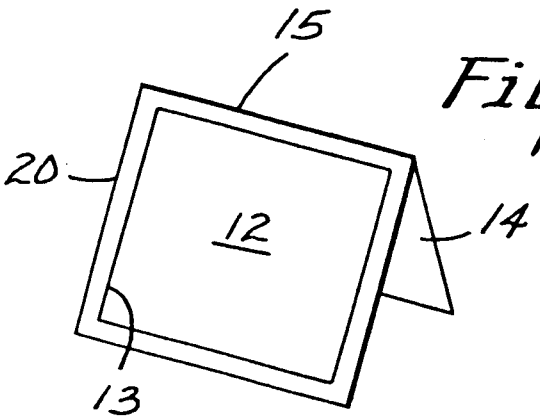
FIG. 3 illustrates master and identifying portions of the form of FIG. 1 that have been removed and folded as part of the method according to the present invention for providing custom printed products to a customer.

Referring now to the drawing, there is shown a form according to the present invention that is generally designated by the reference numeral 10 and can be used by a customer to order custom printed products, which form 10 is specifically intended for use by a customer to order custom printed surfaces on sheets to be included in note pads.

The form 10 comprises a master portion 12 corresponding in size and shape to a surface to be printed on which may, as illustrated, be printed with a light blue ink a rectangular boundary 13 that will not cause a corresponding line to be printed, within which boundary 13 indicia to be printed should be located to provide a margin around the indicia that insures that small errors in cutting the printed sheets will not cut into the printing resulting from the indicia. The form 10 also includes an identifying portion 14 for accepting identifying information concerning the customer by having printed lines on which the name and address of the customer can be printed by the customer; and an informational portion 18 bearing detailed written instructions concerning the use of the form 10. The master and identifying portions 12 and 14 of the form 10 have adjacent edges 15 of the same length (e.g., 10.2 centimeters or 4 inches) joined to each other and along which edges 15 the form 10 is perforated. The form 10 is also perforated along a boundary 20 between the informational portion 18 and the master and identifying portions 12 and 14 of the form 10 to afford separation of the master and identifying portions 12 and 14 of the form 10 as a unit from the informational portion 18 of the form 10. The identifying portion 14 has a length (e.g., 5.4 centimeters or 2.13 inches) that is about 70 percent of or significantly less than the length of the master portion 12 (e.g., 7.6 centimeters or 3 inches) in a direction at a right angle to the joined adjacent edges 15. The perforations along the edges 15 afford folding between the master portion 12 and the identifying portion 14 after they have been removed as a unit from the informational portion 18, and since the identifying portion 14 of the form 10 is smaller in area than and of the same width as the master portion 12, the identifying portion 14 will be completely overlaid by the master portion 12 when the master and identifying portions 12 and 14 have been removed as a unit and folded along their adjacent edges 15.

The identifying portion 14 may also have security symbol means for identifying the form such as a security symbol 21 applied by laser printing or including magnetic coding or consecutive numbering, etc., to insure that the form 10 is an original, which is useful where the form 10 is purchased through a vendor from the party that will print the sheets to insure that that party will not print sheets from a form that did not originate from him.

Figure 4:
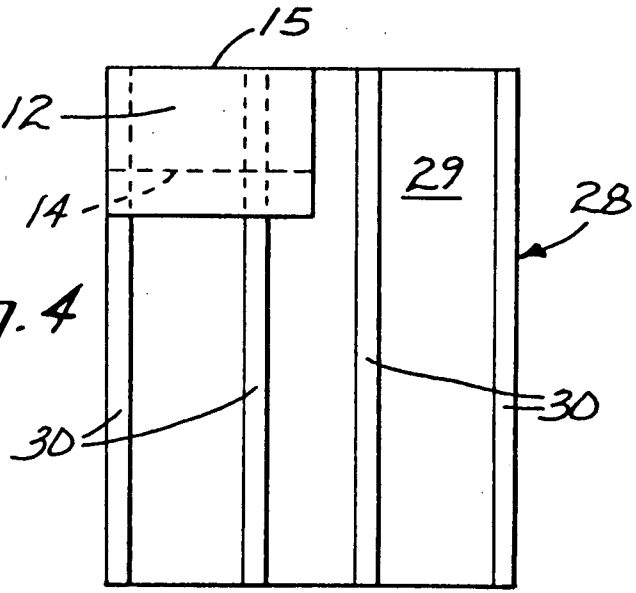
FIG. 4 illustrates a master layout board having attached thereto the removed and folded master and identifying portions illustrated in FIG. 3 as part of the method according to the present invention for providing custom printed products to a customer.
Figure 1:
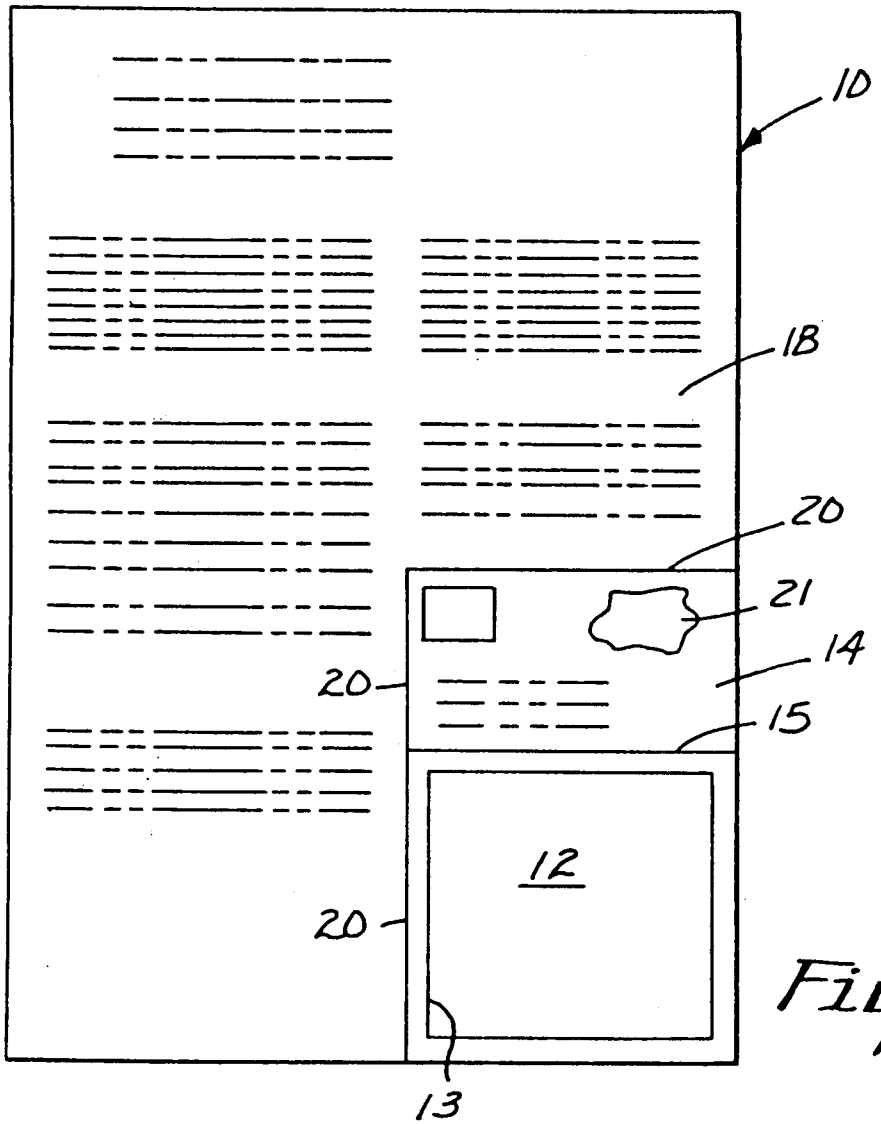
FIG. 1 is a plan view of a form according to the present invention that can be used by a customer to order custom printed products such as sheets.
Figure 2:
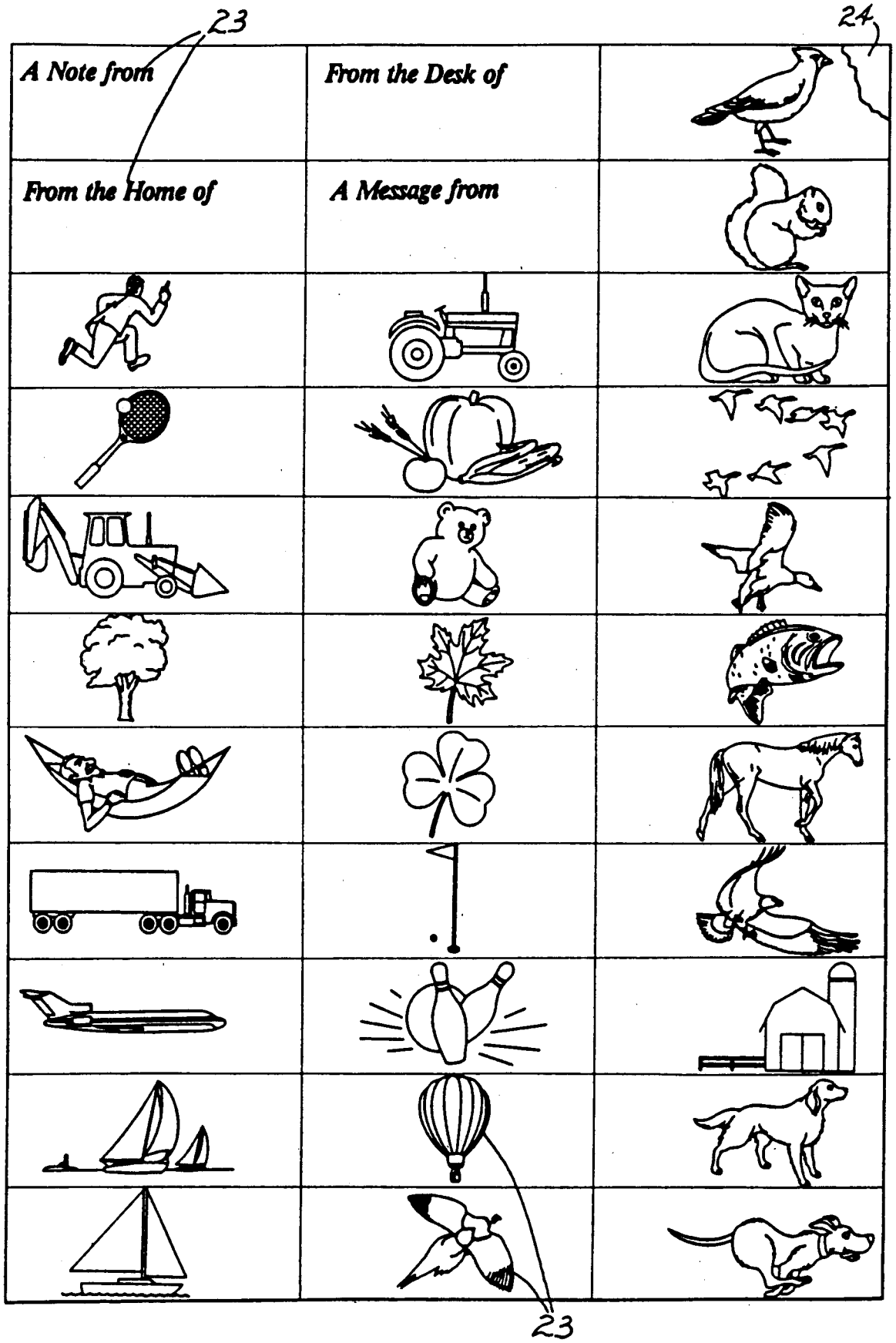
FIG. 2 illustrates a plurality of separable indicia adhered by a repositionable adhesive to a backing, which indicia can be removed from the backing and used in conjunction with the form of FIG. 1 in a method according to the present invention for providing custom printed products to a customer.

A method utilizing the form 10 for providing custom printed surfaces on sheets to a customer is schematically illustrated in FIGS. 2 through 4. The customer is provided with both the form 10 and a supply of different prepared indicia 23 on small sheets such as those illustrated in FIG. 2 in the form of printed messages or depicting, for example, animals, birds, plants, buildings, vehicles, or persons engaged in various activities; which small sheets have repositionable pressure sensitive adhesive on their sides opposite the indicia 23, are supplied releasably adhered to a support sheet 24, and are adapted to be peeled from the support sheet 24 and removably adhered in a desired position to the master portion 12 of the form 10. The customer applies identifying information such as his or her name and address to the identifying portion 14 of the form 10. The customer also applies indicia of a desired type within the boundary 13 to the master portion 12 of the form 10, which may or may not include (1) adhering to the master portion 12 one or more of the small indicia 23 bearing sheets; (2) printing words or letters on the master portion 12 manually, or by using transfer letters, or by using a printer such as a typewriter; or (3) manually drawing artwork on the master portion 12 of the form 10.

The master and identifying portions 12 and 14 of the form 10 are separated from the the informational portion 18 of the form 10 while leaving the master and identifying portions 12 and 14 joined together along their edges 15 which can be done before or after the identifying information and indicia are applied as described above. As is illustrated in FIG. 3, the joined master and identifying portions 12 and 14 are then folded along their adjacent edges 15 to position the identifying portion 14 along the side of the master portion 12 opposite the indicia applied to the master portion 12. The joined and folded master and identifying portions 12 and 14 of the form 10 are then positioned or releasably adhered at a predetermined location on a substrate with the master portion 12 of the form 10 opposite the substrate to provide a graphic master for preparation of the printed sheets. This can be done as illustrated in FIG. 4 by providing a master layout board 28 having a support surface 29 and having areas or elongate spaced strips 30 of low tack pressure sensitive adhesive along the support surface 29, which strips 30 can be provided by lengths of tape coated with adhesive on both sides; and by hand pressing the folded joined master and identifying portions 12 and 14 into engagement with the strips 30 of low tack pressure sensitive adhesive with the identifying portion 14 adjacent the strips 30. The strips 30 will adhere across the identifying portion 14 including across its edge 15, and will adhere across the part of the rear surface of the master portion 12 opposite that edge 15 that extends past the identifying portion 14, so that the strips 30 firmly adhere the master portion 12 to the layout board 28. Typically, other joined and folded master and identifying portions are also pressed into engagement with the strips 30 of adhesive until the master layout board 28 is covered, after which the master portions on the master layout board 28 are used to make a printing plate utilizing conventional printing methods including making a printing plate by which the sheets are printed either directly from the master portions on the lay out board 28 or by photographing the master portions on the lay out board 28.

After the master portion 12 is no longer needed on the master layout board 28, the master and identifying portions 12 and 14 can be separated from the layout board 28. The master portion 12 can be used to identify the appropriate printed sheets that resulted from it, after which the identifying portion 14 can be removed from the master portion 12 between the perforations along the edges 15 and used as a label to send the printed sheets to the customer.

The form and method according to the present invention have now each been described with reference to one embodiment thereof. It will be apparent to those skilled in the art that many changes can be made in the form and method described without departing from the scope of the present invention. For example, surfaces on products other than sheets (e.g., articles such as dispensers, or textiles) can be printed using the form 10 and/or method described above, and the printing can be done by many methods that can utilize the master portion 12 of the form 10 as a graphic master after indicia of a desired type have been applied thereto by a customer (e.g., laser Printing). Thus the scope of the present invention should not be limited to the structures described in this application, but only by structures described by the language of the claims and the equivalents of those structures.

I claim:

1. A method for providing custom printed sheets to a person comprising the steps of:

providing a form comprising a master portion corresponding in size and shape to a sheet to be printed and an identifying portion for accepting identifying information concerning the person;

having the person apply identifying information to the identifying portion of the form, and indicia of a desired type to the master portion of the form;

using the master portion of the form with the applied indicia as a graphic master used in printing the printed sheets; and using the identifying portion of the form as a label to send the printed sheets to the person.

2. A method according to claim 1 further providing the step of providing a supply of prepared indicia adapted to be attached by an adhesive to the master portion of the form.

3. A method according to claim 1 wherein the master portion and the identifying portion of the form have adjacent edges joined to each other and adapted to afford folding the form along the adjacent edges, the identifying portion of the form is smaller in area than the master portion of the form and is completely overlaid by the master portion of the form when the form is folded along the adjacent edges, and said step of using the master portion of the form with the applied indicia as a graphic master to prepare the printed sheets comprises the step of folding the form along the adjacent edges to position the identifying portion along the side of the master portion opposite the indicia applied to the master portion, and releasably adhering the identifying portion and the master portion at a predetermined location on a substrate with the identifying portion adjacent the substrate.

4. A method according to claim 3 wherein said releasably adhering step includes the steps of providing a master layout board having a support surface and having areas of low tack pressure sensitive adhesive along the support surface, and pressing the folded form into engagement with the areas of low tack pressure sensitive adhesive with the identifying portion adjacent the adhesive.

5. A method for providing custom printed sheets to a person comprising the steps of:

providing a form comprising a master portion corresponding in size and shape to a sheet to be printed, an identifying portion for accepting identifying information concerning the person, and an informational portion bearing written instructions concerning the use of the form; the master and identifying portions of the form having adjacent edges joined to each other; the form being perforated along the boundary between the informational portion and the master and identifying portions of the form to afford separation of the master and identifying portions of the form as a unit from the informational portion of the form; the adjacent edges of the master portion and the identifying portion of the form being adapted to afford folding the master and identifying portions of the form along the adjacent edges, and the identifying portion of the form being smaller in area than the master portion of the form and being completely overlaid by the master portion of the form when the form is folded along the adjacent edges, providing a supply of prepared indicia adapted to be attached to the form by a repositionable adhesive;

having the person apply identifying information to the identifying portion of the form, and indicia of a desired type to the master portion of the form;

separating the identifying and master portions from the informational portion of the form while leaving the identifying and master portions joined together;

folding the joined identifying and master portions along their adjacent edges to position the identifying portion along the side of the master portion opposite the indicia applied to the master portion; releasably adhering the joined and folded identifying and master portions of the form at a predetermined location on a substrate with the master portion of the form opposite the substrate to provide a graphic master for preparation of the printed sheets; and separating the identifying portion of the form from the substrate and using the identifying portion of the form as a label to send the printed sheets to the person.

6. A method according to claim 5 wherein said releasably adhering step includes the steps of providing a master layout board having a support surface and having areas of low tack pressure sensitive adhesive along the support surface, and pressing the folded form into engagement with the areas of low tack pressure sensitive adhesive with the identifying portion adjacent the adhesive.

7. A method for providing a custom printed surface on a product for a person comprising the steps of:

providing a form comprising a master portion corresponding in size and shape to the surface to be printed and an identifying portion for accepting identifying information concerning the person;

having the person apply identifying information to the identifying portion of the form, and indicia of a desired type to the master portion of the form;

using the master portion of the form with the applied indicia as a graphic master used in printing the printed surface; and using the identifying portion of the form as a label to send the product to the person.

8. A method according to claim 7 further providing the step of providing a supply of prepared indicia adapted to be attached by an adhesive to the master portion of the form.

9. A method according to claim 7 wherein the master portion of the form and he identifying portion of the form have adjacent edges joined to each other and adapted to afford folding the form along the adjacent edges, the identifying portion of the form is smaller in area than the master portion of the form and is completely overlaid by the master portion of the form when the form is folded along the adjacent edges, and said step of using the master portion of the form with the applied indicia as a graphic master comprises the step of folding the form along the adjacent edges to position the identifying portion along the side of the master portion opposite the indicia applied to the master portion, and releasably adhering the identifying portion and the master portion at a predetermined location on a substrate with the identifying portion adjacent the substrate.

10. A method according to claim 9 wherein said releasably adhering step includes the steps of providing a master layout board having a support surface and having areas of low tack pressure sensitive adhesive along the support surface, and pressing the folded form into engagement with the areas of low tack pressure sensitive adhesive with the identifying portion adjacent the adhesive.

* * * * *

UNITED STATES PATENT AND TRADEMARK OFFICE

CERTIFICATE OF CORRECTION

PATENT NO. : 5,039,132

DATED : August 13, 1991

INVENTOR(S) : Donn R. Anderson

It is certified that error appears in the above-identified patent and that said Letters Patent is hereby corrected as shown below:

Col. 7, line 18, "portion of the form and he identifying portion of the", should read--portion of the form and the identifying portion of the--.

Signed and Sealed this

Twelfth Day of January, 1993

*Attest:*

*Attesting Officer*

DOUGLAS B. COMER

*Acting Commissioner of Patents and Trademarks*